US006502313B1

(12) United States Patent
Bilodeau

(10) Patent No.: US 6,502,313 B1
(45) Date of Patent: Jan. 7, 2003

(54) EDGE TRIMMING TOOL

(76) Inventor: Jérôme Bilodeau, FABRICATION J.B.C. 65, Chemin Price, Falardeau, Québec (CA), G0V 1C0

( * ) Notice: Subject to any disclaimer, the term of this patent is extended or adjusted under 35 U.S.C. 154(b) by 30 days.

(21) Appl. No.: 09/589,162

(22) Filed: Jun. 8, 2000

(30) Foreign Application Priority Data

Jun. 9, 1999 (GB) ..... 9913276

(51) Int. Cl.[7] ..... B26B 25/00
(52) U.S. Cl. ..... 30/292; 30/319; 83/485
(58) Field of Search ..... 30/314, 292, 319, 30/315, 316; 451/419, 423; 83/455; 269/287

(56) References Cited

U.S. PATENT DOCUMENTS 254,520 A * 3/1882 Warren
436,530 A * 9/1890 Markillie
440,879 A * 11/1890 Jackson
907,456 A * 12/1908 Butler
1,181,281 A * 5/1916 Albert
1,367,703 A * 2/1921 Johnson
1,476,234 A * 12/1923 Beeler
1,494,120 A * 5/1924 Kuhlman
1,800,096 A * 4/1931 Nishimura
1,826,517 A * 10/1931 Klockner et al.
1,916,887 A * 7/1933 McClain
2,673,396 A * 3/1954 Beres
5,355,588 A * 10/1994 Brandenburg, Jr. et al.

* cited by examiner

*Primary Examiner*—Allan N. Shoap
*Assistant Examiner*—Thomas J. Druan, Jr.

(57) ABSTRACT

An edge trimming tool for trimming the edge of a piece of material. The edge trimming tool includes a trimming head rotatably attached to a handle. The trimming head defines a first cylindrical section having a peripheral surface and a pair of substantially flat side surfaces. The trimming head also defines a second cylindrical section extending laterally from one of the side surfaces of the first cylindrical section. The second cylindrical section also includes a peripheral surface and a side surface located opposite the first cylindrical section. The intersection between the outer peripheral edge and one of the flat lateral edges of the first cylinder defines a substantially sharp cutting intersection adapted to be used for cutting the material to be trimmed. The first cylindrical section having a greater diameter than the second cylindrical section, a general annular abutment section is defined by the remaining section of the lateral surface of the first cylindrical section from which the second cylindrical section extends. This abutment section is adapted to be used for maintaining proper alignment during the trimming operation.

6 Claims, 2 Drawing Sheets

EDGE TRIMMING TOOL

FIELD OF THE INVENTION

The present invention relates to the general field of cutting or trimming tools and is particularly concerned with an edge trimming tool.

BACKGROUND OF THE INVENTION

The exists a plurality of situations wherein it is desirable to trim or remove border edges of sheet material or the like exceeding the edge of a supporting body or structure. In other words, there exists a plurality of situations wherein it would be desirable to trim or remove a relatively narrow border edge section of material that extends beyond the peripheral edge of an underlying structure so that once the trimming operation is performed the peripheral edges of both the sheet material and the supporting structure are substantially in register with each other.

For example, it is not uncommon when wall paper is applied to a wall that, after the initial application of the wall paper to the wall, a peripheral section of the wall paper exceeds the convex corner edge formed by intersecting walls. Another example relates to the construction of models such as scale replicas of airplanes, automobiles or the like.

In such applications, it is highly desirable to cut the sheet material during application in a smooth and straight line. It is also frequently desirable to cut the sheet material during application on a supporting structure at a predetermined unit distance from a border or edge of the supporting structure. A uniform cut likely improves adherence of the sheet material to the supporting structure to which it is applied and provides an aesthetically pleasing result.

Another common example of the situation wherein it is highly desirable to trim or cut the edge of a sheet of material mounted over supporting structure is found in the field of furniture manufacturing. Indeed, structures such as counter tops, desk tops and the like are commonly finished by applying a sheet of covering material to both the top and side surfaces of the structure. Such sheets of covering material are typically made of various materials including laminated polymeric resins such as Formica, Textolite and the like. Since the sheets of covering material are rarely exactly cut to the dimensions of the supporting structures, it is almost always required to cut or trim a peripheral exceeding section of the sheet of material exceeding over the edge formed by the peripheral edges of the surfaces of the supporting structure.

The usual manner of accomplishing this edge trimming operation involves using both a conventional hand operated portable router and a manually operated filing blade. Indeed, since the typical hand operated power router is often unable to operate in areas of limited access such as blind corners where the trimming tool must be moved adjacent adjoining wall surfaces, hand filing is often also required. Hand filing is also generally required to finish the edge so as to remove burrs, nicks and any sharp edges on the work piece.

Furthermore, the proposed tool is specifically designed so as to be ergonomical and allow for edge trimming through a set of simple steps that require a minimal amount of time to be performed.

For example, hand filing is somewhat of an art and an unskilled worker can easily ruin an expensive work-piece during the final stages of preparation.

Accordingly, there exists a need for an improved edge trimming tool.

Advantages of the present invention include that the proposed tool is particularly well adapted to trim the edge of a sheet of material exceeding the edge of a supporting body on which it is mounted.

The proposed tool is specifically designed so as to allow for accurate trimming of the exceeding edge without requiring special tooling or manual dexterity.

In accordance with an embodiment of the invention there is provided an edge trimming tool for trimming a peripheral protruding section part of a sheet of trimmable material mounted over a supporting body, the supporting body defining a first supporting body surface, and a second supporting body surface, the first and second supporting body surfaces being in a generally perpendicular relationship relative to each other and defining a peripheral supporting body edge at the merging intersection between the first and second supporting body surfaces, the sheet of covering material being fixedly mounted over at least a portion of the first supporting body surface with the peripheral protruding section extending outwardly beyond the peripheral supporting body, the edge trimming tool comprising: a handle, the handle defining a handle first longitudinal end, a handle second longitudinal end and a handle longitudinal axis; a trimming head rotatably attached to the handle adjacent the handle first longitudinal end by an attachment means allowing the trimming head to rotate relative to the handle about a rotating axis, the rotating axis being in a generally perpendicular relationship relative to the handle longitudinal axis; the trimming head defining a first cylindrical section, the first cylindrical section having a generally circular first cylinder peripheral surface, a generally flat first cylinder first side surface and an opposed generally flat first cylinder second side surface, the first cylinder first side surface defining a first cylinder first side surface outer peripheral edge, the first cylinder peripheral surface defining corresponding first cylinder peripheral surface first and second lateral edges and the first cylinder defining a first cylinder outer diameter and a first cylinder length; a second cylindrical section, the second cylindrical section having a generally circular second cylinder peripheral surface, the second cylindrical section defining a second cylinder outer diameter and a second cylinder length, the second cylinder outer diameter being smaller then the first cylinder outer diameter; the second cylindrical section extending integrally and laterally from a generally centrally disposed central section of the first cylinder first side surface so as to define a generally flat second cylinder outer side surface located opposite the central section; the intersection between the first cylinder first side surface outer peripheral edge and the first cylinder peripheral surface first lateral edge defining a substantially sharp cutting intersection; the first cylinder first side surface also defining a generally annular abutment section extending from the central section to the first cylinder first side surface outer peripheral edge; whereby, the trimming tool is adapted to be initially positioned with the second cylinder peripheral surface in frictional contact with the upper surface of the sheet of covering material and the abutment section contacting the second supporting body surface, the second cylinder being adapted to be rolled on the upper surface of the sheet of covering material thereby rotatably driving the cutting intersection as the latter trims the peripheral protruding section and the abutment section guides the cutting intersection in alignment with the peripheral supporting body edge.

Conveniently, the second cylinder peripheral surface is provided with a friction enhancing means for enhancing its friction coefficient; whereby the friction coefficient increases the frictional force between the second cylinder peripheral surface and the upper surface of the sheet of covering material and reduces the risk of slippage therebetween when the second cylinder peripheral surface is rolled on the upper surface of the sheet of covering material. Preferably, the friction enhancing means includes a relief texture formed on the second cylinder peripheral surface.

Preferably, the edge trimming tool further comprises a sharpening means for sharpening the cutting intersection when the trimming head is used. Preferably, the sharpening means includes a sharpening section formed on the handle adjacent the handle first longitudinal end, the sharpening surface being configured and positioned so as to be in contact with the cutting intersection when the cutting head is used.

Conveniently, the handle first longitudinal end defines a handle first surface extending generally in a first geometrical plane, the first geometrical plane being in a substantially parallel relationship relative to the rotational axis and in a substantially perpendicular relationship relative to the handle longitudinal axis, the first geometrical plane also being in a generally proximal relationship relative to the first cylinder peripheral surface; the handle first longitudinal end also defining a handle second surface extending generally in a second geometrical plane, the second geometrical plane being in a substantially parallel relationship relative to the first geometrical plane, the second geometrical plane being in a generally proximal relationship relative to the second cylinder peripheral surface so that the handle first surface is in a recessed relationship relative to the handle second surface in a direction leading towards the handle second longitudinal end; the handle first longitudinal end further defining a handle third surface extending generally in a third geometrical plane, the third geometrical plane being in a substantially perpendicular relationship relative to the first and second geometrical planes, the third geometrical plane being in a generally proximal relationship relative to the abutment section; the intersection of the handle first surface and the handle third surface defining the sharpening section; the trimming head being mounted on the handle so that the cutting intersection contacts the sharpening section when the trimming head is being used.

Preferably, the sharpening section has a substantially abrasive surface texture. Preferably, the attachment means includes a pair of mounting tongues extending from the handle first longitudinal end in a spaced relationship relative to each other, each of the mounting tongues defining a corresponding mounting tongue inner surface and an opposed mounting tongue outer surface, the mounting tongues being sufficiently spaced relative to each other so as to accommodate the trimming head therebetween; a mounting channel extending longitudinally through the trimming head; an axle extending through the mounting channel for rotatably supporting the trimming head, the axle being attached at each longitudinal end thereof to one of the mounting tongues.

Conveniently, a spacing washer is mounted on the axle between the trimming head and both of the mounting tongue inner surfaces. Preferably, the cutting intersection is provided with serrations formed thereon.

In accordance with the present invention there is also provided an edge trimming tool for trimming a peripheral protruding section part of a sheet of trimmable material mounted over a supporting body, the supporting body defining a first supporting body surface, and a second supporting body surface, the first and second supporting body surfaces being in a generally perpendicular relationship relative to each other and defining a peripheral supporting body edge at the merging intersection between the first and second supporting body surfaces, the sheet of covering material being fixedly mounted over at least a portion of the first supporting body surface with the peripheral protruding section extending outwardly beyond the peripheral supporting body, the edge trimming tool comprising: a handle, the handle defining a handle first longitudinal end, a handle second longitudinal end and a handle longitudinal axis;

a trimming head rotatably attached to the handle adjacent the handle first longitudinal end by an attachment means allowing the trimming head to rotate relative to the handle about a rotating axis, the rotating axis being in a generally perpendicular relationship relative to the handle longitudinal axis; the trimming head defining a first cylindrical section, the first cylindrical section having a generally circular first cylinder peripheral surface, a generally flat first cylinder first side surface and an opposed generally flat first cylinder second side surface, the first cylinder first side surface defining a first cylinder first side surface outer peripheral edge, the first cylinder peripheral surface defining corresponding first cylinder peripheral surface first and second lateral edges and the first cylinder defining a first cylinder outer diameter and a first cylinder length; a second cylindrical section the second cylindrical section having a generally circular second cylinder peripheral surface, the second cylindrical section defining a second cylinder outer diameter and a second cylinder length, the second cylinder outer diameter being smaller then the first cylinder outer diameter; the second cylindrical section extending integrally and laterally from a generally centrally disposed central section of the first cylinder first side surface so as to define a generally flat second cylinder outer side surface located opposite the central section;

the intersection between the first cylinder first side surface outer peripheral edge and the first cylinder peripheral surface first lateral edge defining a substantially sharp cutting intersection;

the first cylinder first side surface also defining a generally annular abutment section extending from the central section to the first cylinder first side surface outer peripheral edge;

the second cylinder peripheral surface being provided with a friction enhancing means for enhancing its friction coefficient, the trimming tool further comprising a sharpening means for sharpening the cutting intersection when the trimming head is used.

BRIEF DESCRIPTION OF THE DRAWINGS

An embodiment of the present will now be disclosed, by way of example, in reference to the following drawings in which.

DETAILED DESCRIPTION

Figure 1:
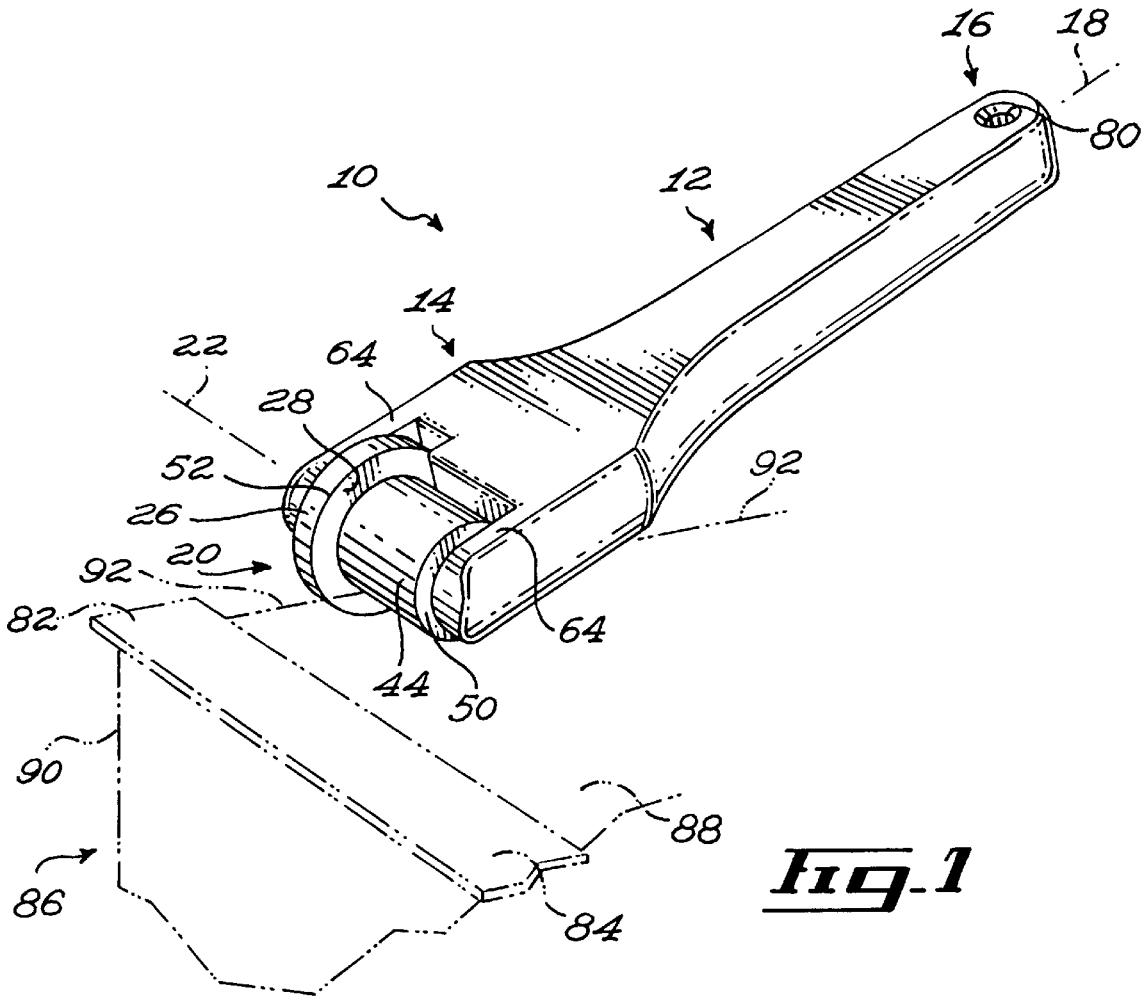
FIG. 1: in a perspective view, illustrates an edge trimming tool in accordance with an embodiment of the present invention.
Figure 2:
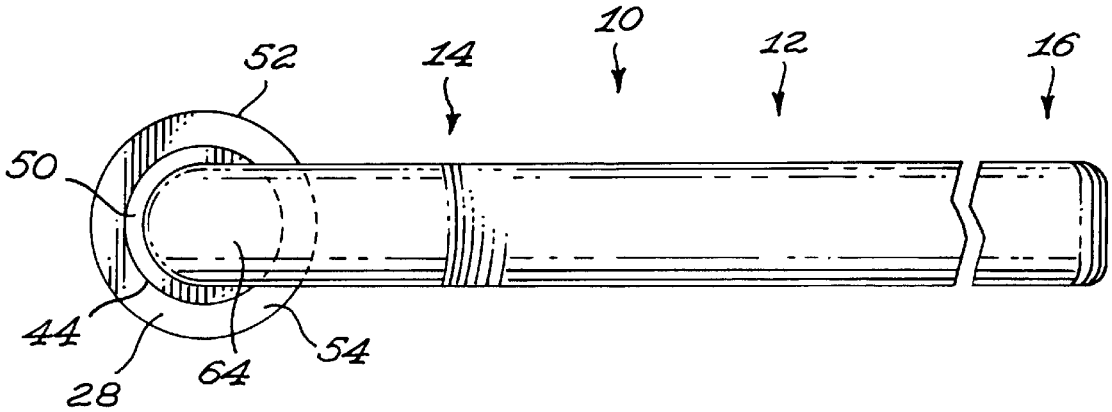
FIG. 2: in a side elevational view, illustrates the edge trimming tool shown in FIG. 1.

Referring to FIG. 1, there is shown an edge trimming tool 10 in accordance with an embodiment of the present invention.

The edge trimming tool 10 is shown about to be used for trimming a peripheral exceeding section 82 part of a sheet of covering material 84 mounted over a supporting body 86.

The supporting body 86 defines a first supporting body surface 88 and a second supporting body surface 90.

The first and second supporting body surfaces 88, 90 are in a generally perpendicular relationship relative to each other and define a peripheral supporting body edge 92 at the merging intersection between the first and second supporting body surfaces 88, 90. The sheet of covering material is fixedly mounted over at least a portion of the first supporting body surface 88 with the exceeding section 82 extending outwardly beyond the peripheral supporting body edge 92.

The edge trimming tool 10 includes a handle 12, preferably having a generally elongated configuration and defining a handle first longitudinal end 14, an opposed handle second longitudinal end 16 and a handle longitudinal axis 18. trimming head 20 is rotatably attached to the handle 12 adjacent the handle first longitudinal end 14 by an attachment means. The attachment means allows the trimming head 20 to rotate relative to the handle 12 about a rotating axis 22. The rotating axis 22 is typically in a generally perpendicular relationship relative to handle longitudinal axis 18.

Figure 4:
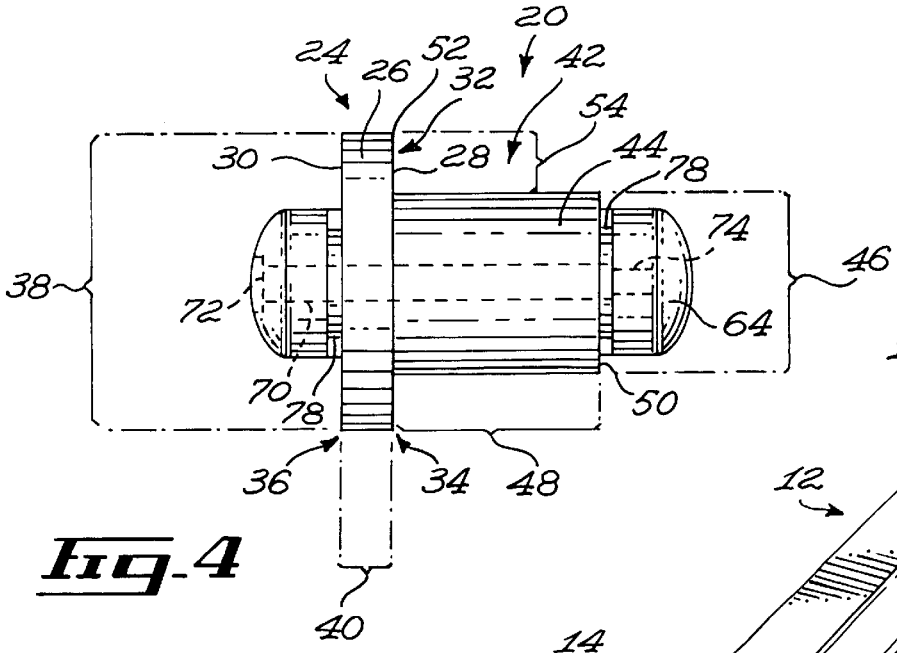
FIG. 4: in an end view, illustrates an edge trimming tool shown in FIGS. 1 through 3.

As shown more specifically in FIG. 4, the trimming head 20 defines a first cylindrical section 24. The first cylindrical section 24 has a generally circular first cylinder peripheral surface 26, a generally flat first cylinder first side surface 28 and an opposed generally flat first cylinder second side surface 30. The first cylinder first side surface 28 defines a first cylinder first side surface outer peripheral edge 32. The first cylinder peripheral surface 26 defines corresponding first cylinder peripheral surface first and second lateral edges 34, 36. The first cylinder defines a first cylinder outer diameter 38 and a first cylinder length 40.

The trimming head 20 also defines a second cylinder section 42 having a generally circular second cylinder peripheral surface 44. The second cylindrical section 42 defines a second cylinder outer diameter 46 and a second cylinder length 48. The second cylinder outer diameter 46 is smaller than the first cylinder outer diameter 38.

The second cylindrical section 42 extends integrally and laterally from a generally centrally disposed central section of the first cylinder first side surface 28 so as to define a generally flat second cylinder outer side surface 50 located opposite the central section from which the second cylindrical section 42 extends. The intersection between the first cylinder first side surface outer peripheral edge 32 and the first cylinder peripheral surface first lateral edge 34 defines a substantially sharp cutting intersection 52. The first cylinder first side surface 28 also defines a generally annular abutment section 54 extending from the central section to the first cylinder first side surface outer peripheral edge 32.

Preferably, the first cylinder peripheral surface 44 is provided with a friction enhancing means for enhancing its friction coefficient. The friction enhancing means typically includes a relief texture formed on the first cylinder peripheral surface. The relief texture may be formed by providing grooves or any other suitable means.

The edge trimming tool 10 preferably further includes a sharpening means for self-sharpening the cutting intersection 52 when the trimming head 20 is being used.

The sharpening means typically includes a sharpening section formed on the handle 20 adjacent the handle first longitudinal end 14. The sharpening surface is typically configured and positioned so as to be positioned so as to be in contact with the cutting intersection 52 when the cutting head 20 is being used.

Figure 3:
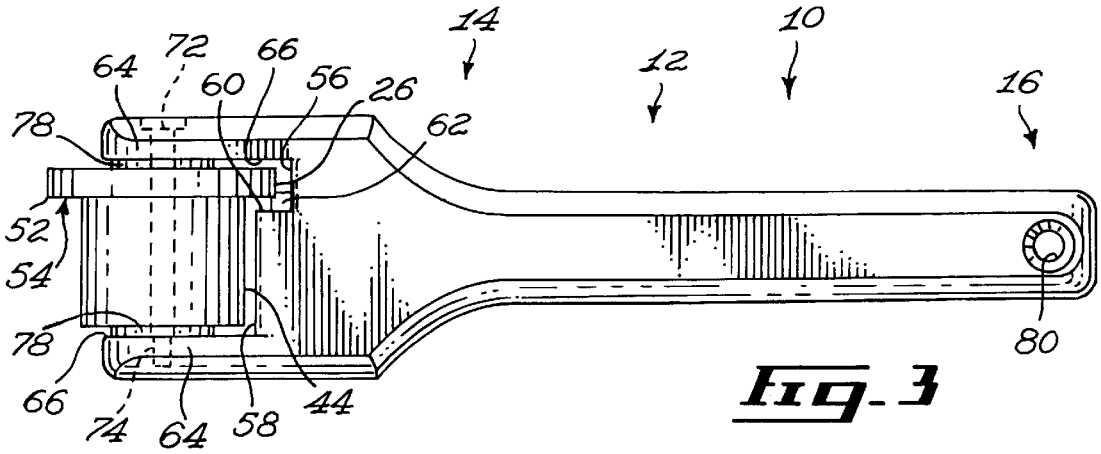
FIG. 3: in a top view, illustrates the edge trimming tool shown in FIGS. 1 and 2.
Figure 5:
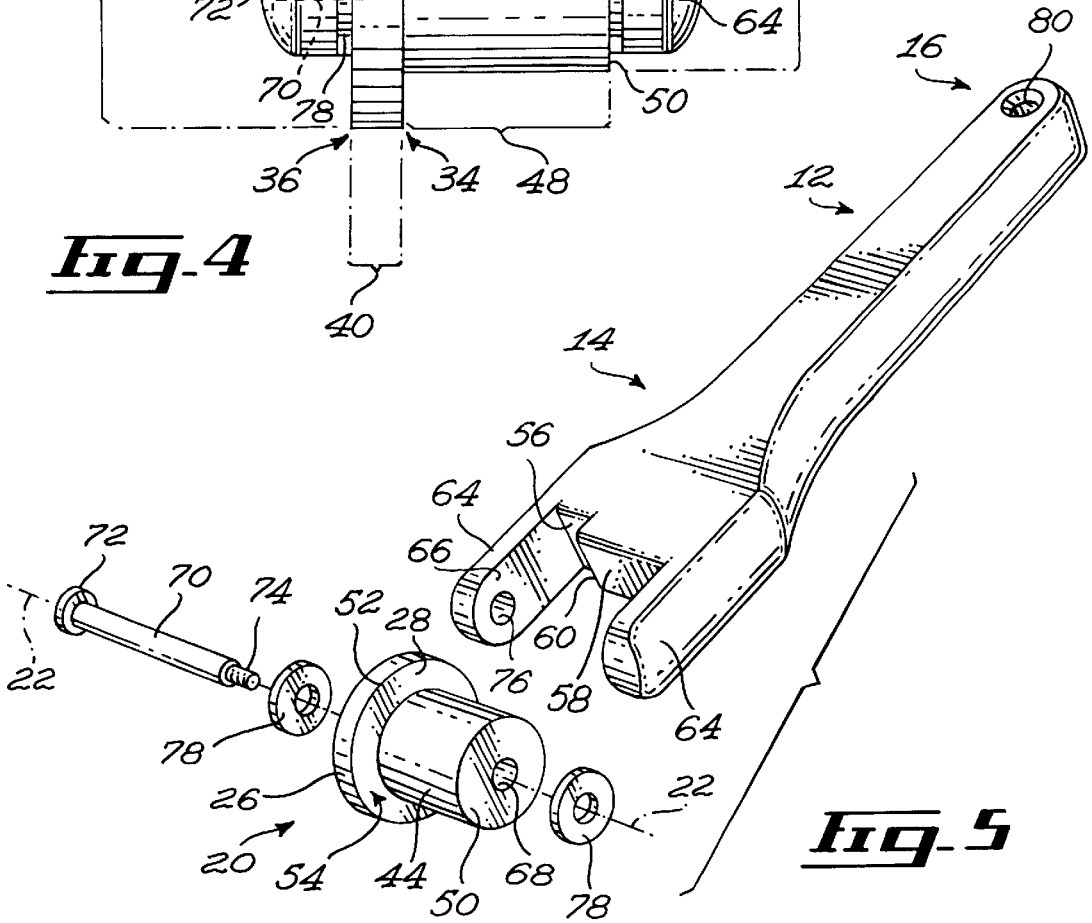
FIG. 5: in a perspective exploded view, illustrates the edge trimming tool shown in FIGS. 1 through 4.

As shown more specifically in FIGS. 3 and 5, the handle first longitudinal end 14 preferably defines a handle first surface 56 extending generally in a first geometrical plane. The first geometrical plane is typically in a substantially parallel relationship relative to the rotational axis 22 and in a substantially perpendicular relationship relative to the handle longitudinal axis 18. The first geometrical plane also is in a generally proximal relationship relative to the first cylinder peripheral surface 26.

The handle first longitudinal end 14 also defines a handle second surface 58 extending generally in a second geometrical plane.

The second geometrical plane is in a substantially parallel relationship relative to the first geometrical plane and in a generally proximal relationship relative to the second cylinder peripheral surface 44.

The handle first surface 56 is thus in a recessed relationship relative to the handle second surface 58 in a direction leading towards the handle second longitudinal end 16.

The handle first longitudinal end 14 further defines a handle third surface 60 extending generally in a third geometrical plane. The third geometrical plane is in a substantially perpendicular relationship relative to the first and second geometrical planes. The third geometrical plane is in a generally proximal relationship relative to the abutment section 54. The intersection of the handle first surface 56 and the handle third surface 60 define the sharpening section. The trimming head 20 is typically mounted on the handle 12 so that the cutting intersection 52 contacts the sharpening section when the trimming head 20 is being used.

In FIGS. 1 and 3, the first cylinder peripheral surface 26 and the abutment section 54 are shown in a relatively spaced relationship respectively relative to the handle first and third surfaces 56, 60 in order to provide a clearer illustration.

Typically, the sharpening section has a substantially abrasive surface texture schematically illustrated by an abrasive block 62 mounted over the sharpening section in FIG. 3.

The attachment means preferably includes a pair of mounting tongues 64 extending from the handle first longitudinal end 14.

The mounting tongues 64 are in a spaced relationship relative to each other so as to accommodate the trimming head 20 therebetween. Each mounting tongue defines a corresponding mounting tongue inner surface 66. The attachment means also includes a mounting channel 68 extending longitudinally through the trimming head 20.

The attachment means further includes an axle 70 extending through the mounting channel 68 for rotatably supporting the trimming head 20. The axle 70 is attached at each longitudinal ends thereof to one of the mounting tongues 64.

In a preferred embodiment of the invention, the axle 70 further includes a screw head 72 at a first longitudinal end thereof and a threaded section 74 at an opposed end thereof.

The axle shaft 70 is adapted to be slidably inserted within a corresponding shaft aperture 76 formed in one of the mounting tongues 64 while the screw head 72 is used for threadably inserting the threaded section 74 in the opposed mounting tongue 64.

Preferably, a spacing washer-type component 78 is mounted on the axle shaft 70 between the trimming head 20 and both of said mounting tongue inner surfaces 66.

In one embodiment of the invention, the cutting intersection 52 is provided with serrations (not shown) formed thereon for increasing its cutting efficiency in certain types of trimmable materials. The washer-type components 78 are adapted to reduce friction between the trimming head 20 and the mounting tongues 64 as well as to stabilize the trimming head 20.

The handle 12 is further preferably provided with a hooking aperture 80 extending transversally therethrough and preferably positioned adjacent the handle second longitudinal end 16. The hooking aperture 80 is adapted to facilitate hooking of the edge trimming tool 10 to a conventional hooking structure extending from a supporting wall or the like.

Preferably, although by no means exclusively, the trimming head 20 is manufactured out of steel or any other suitable material and is preferably integrally manufactured out of a single piece of material.

In use, the handle is first adapted to be used for positioning the edge trimming tool 10 so that the second cylinder peripheral surface 44 frictionally contacts the upper surface of the sheet covering material 84 mounted over at least a portion of the first supporting body surface 88.

Preferably, the tool 10 is positioned initially on a section of the sheet of covering material 84 having its peripheral edge substantially in register with the peripheral supporting body edge 92. The tool 10 is also positioned so that the abutment section 54 of the first cylinder first side surface 28 contacts the second supporting body surface 90.

Pressure is applied on the tool 10 so as to increase the frictional force between the second cylinder peripheral surface 44 and the upper surface of the covering material 84. The handle 12 is then used to push or pull the tool 10 until the cutting edge 52 reaches a portion of the exceeding section 82. The friction between the second cylinder peripheral surface 44 and the top surface of the sheet of covering material 84 causes the cutting intersection 52 to rotate thus allowing the second cylinder peripheral surface 44 to act as a driving means for rotatably driving the cutting intersection 52 while the latter trims the exceeding section 82. The second cylinder peripheral surface 44 also controls the depth of the cut performed by the trimming head 20.

The abutment section 54 abuttingly contacting the second supporting body surface 90 while the trimming head 20 rotates is adapted to maintain the cutting intersection 52 in proper alignment with the peripheral supporting body edge 92. The lateral positioning of the cutting intersection is thus precisely controlled by the abutting contact with the abutment section while the depth of the cutting operation is precisely controlled by the depth of the abutment section. The trimmable edge can thus be trimmed with both lateral and depth precision as well as speed control of the cutting intersection without requiring manual dexterity.

In an alternative embodiment of the invention (not shown) the abutment section 54 is angled relative to the second cylinder peripheral surface 44 and the first cylinder peripheral surface 26.

This allows the abutment section 54 to conform to angled second supporting body surfaces 90 that are found in certain situations.

The embodiments of the invention in which an exclusive privilege or property is claimed are defined as follows:

1. An edge trimming tool for trimming a peripheral protruding section part of a sheet of trimmable material mounted over a supporting body, said supporting body defining a first supporting body surface, and a second supporting body surface, said first and second supporting body surfaces being in a generally perpendicular relationship relative to each other and defining a peripheral supporting body edge at the merging intersection between said first and second supporting body surfaces, said sheet of covering material being fixedly mounted over at least a portion of said first supporting body surface with said peripheral protruding section extending outwardly beyond said peripheral supporting body, said edge trimming tool comprising: a handle, said handle defining a handle first longitudinal end, a handle second longitudinal end and a handle longitudinal axis; a trimming head rotatably attached to said handle adjacent said handle first longitudinal end by an attachment means allowing said trimming head to rotate relative to said handle about a rotating axis, said rotating axis being in a generally perpendicular relationship relative to said handle longitudinal axis; said trimming head defining a first cylindrical section, said first cylindrical section having a generally circular first cylinder peripheral surface, a generally flat first cylinder first side surface and an opposed generally flat first cylinder second side surface, said first cylinder first side surface defining a first cylinder first side surface outer peripheral edge, said first cylinder peripheral surface defining corresponding first cylinder peripheral surface first and second lateral edges and said first cylinder defining a first cylinder outer diameter and a first cylinder length; a second cylindrical section said second cylindrical section having a generally circular second cylinder peripheral surface, said second cylindrical section defining a second cylinder outer diameter and a second cylinder length, said second cylinder outer diameter being smaller then said first cylinder outer diameter; said second cylindrical section extending integrally and laterally from a generally centrally disposed central section of said first cylinder first side surface so as to define a generally flat second cylinder outer side surface located opposite said central section; the intersection between said first cylinder first side surface outer peripheral edge and said first cylinder peripheral surface first lateral edge defining a substantially sharp cutting intersection; said first cylinder first side surface also defining a generally annular abutment section extending from said central section to said first cylinder first side surface outer peripheral edge; said second cylinder peripheral surface being provided with a friction enhancing means for enhancing its friction coefficient, said trimming tool further comprising a sharpening means for sharpening said cutting intersection when said trimming head is used.

2. An edge trimming tool for trimming a peripheral protruding section part of a sheet of trimmable material mounted over a supporting body, said supporting body defining a first supporting body surface, and a second supporting body surface, said first and second supporting body surfaces being in a generally perpendicular relationship relative to each other and defining a peripheral supporting body edge at the merging intersection between said first and second supporting body surfaces, said sheet of covering material being fixedly mounted over at least a portion of said first supporting body surface with said peripheral protruding section extending outwardly beyond said peripheral supporting body, said edge trimming tool comprising:

a handle, said handle defining a handle first longitudinal end, a handle second longitudinal end and a handle longitudinal axis;

a trimming head rotatably attached to said handle adjacent said handle first longitudinal end by an attachment means allowing said trimming head to rotate relative to said handle about a rotating axis, said rotating axis being in a generally perpendicular relationship relative to said handle longitudinal axis; said trimming head defining a first cylindrical section, said first cylindrical section having a generally circular first cylinder peripheral surface, a generally flat first cylinder first side surface and an opposed generally flat first cylinder second side surface, said first cylinder first side surface defining a first cylinder first side surface outer peripheral edge, said first cylinder peripheral surface defining corresponding first cylinder peripheral surface first and second lateral edges and said first cylinder defining a first cylinder outer diameter and a first cylinder length;

a second cylindrical section said second cylindrical section having a generally circular second cylinder peripheral surface, said second cylindrical section defining a second cylinder outer diameter and a second cylinder length, said second cylinder outer diameter being smaller then said first cylinder outer diameter; said second cylindrical section extending integrally and laterally from a generally centrally disposed central section of said first cylinder first side surface so as to define a generally flat second cylinder outer side surface located opposite said central section;

the intersection between said first cylinder first side surface outer peripheral edge and said first cylinder peripheral surface first lateral edge defining a substantially sharp cutting intersection;

said first cylinder first side surface also defining a generally annular abutment section extending from said central section to said first cylinder first side surface outer peripheral edge;

said edge trimming tool further comprising a sharpening means for sharpening said cuffing intersection when said trimming head is used;

whereby, said trimming tool is adapted to be initially positioned with said second cylinder peripheral surface in frictional contact with the upper surface of said sheet of covering material and said abutment section contacting said second supporting body surface, said second cylinder being adapted to be rolled on the upper surface of said sheet of covering material thereby rotatably driving said cutting intersection as the latter trims said peripheral protruding section and said abutment section guides said cutting intersection in alignment with said peripheral supporting body edge.

3. An edge trimming tool for trimming a peripheral protruding section part of a sheet of trimmable material mounted over a supporting body, said supporting body defining a first supporting body surface, and a second supporting body surface, said first and second supporting body surfaces being in a generally perpendicular relationship relative to each other and defining a peripheral supporting body edge at the merging intersection between said first and second supporting body surfaces, said sheet of covering material being fixedly mounted over at least a portion of said first supporting body surface with said peripheral protruding section extending outwardly beyond said peripheral supporting body, said edge trimming tool comprising:

a handle, said handle defining a handle first longitudinal end, a handle second longitudinal end and a handle longitudinal axis;

a trimming head rotatably attached to said handle adjacent said handle first longitudinal end by an attachment means allowing said trimming head to rotate relative to said handle about a rotating axis, said rotating axis being in a generally perpendicular relationship relative to said handle longitudinal axis; said trimming head defining a first cylindrical section, said first cylindrical section having a generally circular first cylinder peripheral surface, a generally flat first cylinder first side surface and an opposed generally flat first cylinder second side surface, said first cylinder first side surface defining a first cylinder first side surface outer peripheral edge, said first cylinder peripheral surface defining corresponding first cylinder peripheral surface first and second lateral edges and said first cylinder defining a first cylinder outer diameter and a first cylinder length;

a second cylindrical section said second cylindrical section having a generally circular second cylinder peripheral surface, said second cylindrical section defining a second cylinder outer diameter and a second cylinder length, said second cylinder outer diameter being smaller then said first cylinder outer diameter; said second cylindrical section extending integrally and laterally from a generally centrally disposed central section of said first cylinder first side surface so as to define a generally flat second cylinder outer side surface located opposite said central section;

the intersection between said first cylinder first side surface outer peripheral edge and said first cylinder peripheral surface first lateral edge defining a substantially sharp cutting intersection;

said first cylinder first side surface also defining a generally annular abutment section extending from said central section to said first cylinder first side surface outer peripheral edge;

said second cylinder peripheral surface being provided with a friction enhancing means for enhancing its friction coefficient; whereby said friction coefficient increases the frictional force between said second cylinder peripheral surface and the upper surface of said sheet of covering material and reduces the risk of slippage therebetween when said second cylinder peripheral surface is rolled on the upper surface of said sheet of covering material said friction enhancing means including a relatively shallow relief texture formed on said second cylinder peripheral surface whereby, said trimming tool is adapted to be initially positioned with said second cylinder peripheral surface in frictional contact with the upper surface of said sheet of covering material and said abutment section contacting said second supporting body surface, said second cylinder being adapted to be rolled on the upper surface of said sheet of covering material thereby rotatably driving said cutting intersection as the latter trims said peripheral protruding section and said abutment section guides said cutting intersection in alignment with said peripheral supporting body edge.

4. An edge trimming tool as recited in claim 2 wherein said sharpening means includes a sharpening section formed on said handle adjacent said handle first longitudinal end, said sharpening surface being configured and positioned so as to be in contact with said cutting intersection when said cutting head is used.

5. An edge trimming tool as recited in claim 4 wherein said handle first longitudinal end defines a handle first surface extending generally in a first geometrical plane, said first geometrical plane being in a substantially parallel relationship relative to said rotational axis and in a substantially perpendicular relationship relative to said handle longitudinal axis, said first geometrical plane also being in a generally proximal relationship relative to said first cylinder peripheral surface; said handle first longitudinal end also defining a handle second surface extending generally in a second geometrical plane, said second geometrical plane being in a substantially parallel relationship relative to said first geometrical plane, said second geometrical plane being in a generally proximal relationship relative to said second cylinder peripheral surface so that said handle first surface is in a recessed relationship relative to said handle second surface in a direction leading towards said handle second longitudinal end; said handle first longitudinal end further defining a handle third surface extending generally in a third geometrical plane, said third geometrical plane being in a substantially perpendicular relationship relative to said first and second geometrical planes, said third geometrical plane being in a generally proximal relationship relative to said abutment section; the intersection of said handle first surface and said handle third surface defining said sharpening section; said trimming head being mounted on said handle so that said cutting intersection contacts said sharpening section when said trimming head is being used.

6. An edge trimming tool as recited in claim 5 wherein said sharpening section has a substantially abrasive surface texture.

* * * * *